US007777421B2

(12) United States Patent
Mishimagi

(10) Patent No.: US 7,777,421 B2
(45) Date of Patent: Aug. 17, 2010

(54) LIGHT EMITTING DEVICE

(76) Inventor: Kazuharu Mishimagi, c/o Hayashi Chemical Indutry Co., Ltd., 16-14, Koenji-Minami 5-chome, Suginami-ku, Tokyo 166-0003 (JP)

( * ) Notice: Subject to any disclaimer, the term of this patent is extended or adjusted under 35 U.S.C. 154(b) by 532 days.

(21) Appl. No.: 11/836,406

(22) Filed: Aug. 9, 2007

(65) Prior Publication Data

US 2008/0037303 A1 Feb. 14, 2008

(30) Foreign Application Priority Data

Aug. 10, 2006 (JP) ..... 2006-218497

(51) Int. Cl.
*H05B 37/02* (2006.01)

(52) U.S. Cl. ..... 315/209 R; 315/246

(58) Field of Classification Search ..... 315/185 R, 315/186, 209 R, 210, 224, 246, 247, 291, 315/299

See application file for complete search history.

(56) References Cited

U.S. PATENT DOCUMENTS

| | | | | |
|---|---|---|---|---|
| 5,345,167 | A * | 9/1994 | Hasegawa et al. | 323/349 |
| 6,320,330 | B1 * | 11/2001 | Haavisto et al. | 315/291 |
| 6,950,079 | B2 * | 9/2005 | Inoue | 345/46 |
| 7,295,176 | B2 * | 11/2007 | Yang | 345/82 |

FOREIGN PATENT DOCUMENTS

| | | | |
|---|---|---|---|
| JP | 11-68161 | A | 9/1999 |
| JP | 2005-072546 | A | 3/2005 |
| JP | 2006-049423 | A | 2/2006 |
| JP | 2006-059930 | A | 3/2006 |
| JP | 2006-147252 | A | 6/2006 |
| JP | 2006-172820 | A | 6/2006 |
| JP | 2006-202855 | A | 8/2006 |

OTHER PUBLICATIONS

"Initial Notification of Reason(s) for Refusal", Dispatch No. 665191, Dispatched date: Dec. 25, 2007, 7pgs.
"2nd Initial Notification of Reasons(s) for Refusal", Dispatch No. 229237, Dispatched date: Apr. 30, 2008, 5pgs.
"Decision of Refusal", Dispatch No. 515367, Dispatched date: Sep. 2, 2008, 5pgs.

* cited by examiner

*Primary Examiner*—Thuy Vinh Tran

(57) ABSTRACT

An object of the invention is to suppress the amount of heat generated by a light emitting diode and prevent the light emitting diode from being overheated without reducing the amount of emitted light even when the light emitting diode is a high-power light emitting diode. A light emitting device is configured so that one or more light emitting diodes (11) are lighted by a lighting circuit (12). A DC power is converted into a pulse power by a switching regulator (13) of this lighting circuit (12) and the voltage of a pulse power converted by this switching regulator is lowered by an output control portion (14). The pulse width of a pulse power lowered in voltage by this output control portion is adjusted by a pulse width adjusting oscillation means (16), and the current of a pulse power adjusted in pulse width by this pulse width adjusting oscillation means is limited by a limiting resistor (17). The light emitting device is configured so that a pulse power limited in current by this limiting resistor is outputted to a light emitting diode.

2 Claims, 4 Drawing Sheets

LIGHT EMITTING DEVICE

BACKGROUND OF THE INVENTION

1. Field of the Invention

The present invention relates to a light emitting device for lighting a light emitting diode (LED) by means of a lighting circuit.

2. Description of the Invention

Up to now, as a device of this kind, there has been disclosed a light emitting device for simultaneously lighting light emitting diodes of a light emitting unit by making a lighting circuit receive a DC power from a DC power source, said light emitting unit being formed by arranging a plurality of light emitting diodes and connecting these light emitting diodes with each other (see Patent Document 1 for example). This light emitting device is configured so that a DC power is inputted into a switching regulator of the lighting circuit from a DC power source and this switching regulator performs a switching operation according to the magnitude of electric current flowing through the light emitting unit. And it is configured so that a pulse current obtained by the switching operation of the switching regulator is smoothed into a direct current by a smoothing circuit and supplied to the light emitting unit.

In a light emitting device configured in such a way, since a constant-current circuit is formed out of a switching regulator and a smoothing circuit, a current limiting resistor does not need to be provided and no efficiency degradation is caused by some voltage drop and a high efficiency can be maintained. And even when fluctuation in voltage drop of light emitting diodes is caused by a voltage fluctuation of a DC power source or a temperature change, since an electric current flowing through light emitting diodes is kept at a constant value and a proper loaded state is maintained, sufficient luminance brightness and high reliability can be obtained.

Patent Document 1: Japanese Unexamined Patent Application Publication No. 1999-68161 (claim 1, Paragraph [0006], Paragraph [0017])

SUMMARY OF THE INVENTION

In a light emitting device disclosed in the above-mentioned conventional Patent Document 1, however, in case of using a high-power light emitting diode, there has been the possibility that the light emitting diode is overheated and damaged due to the increase in amount of heat generated by the light emitting diode when the electric current to flow through the light emitting diode is increased in order to increase the amount of light of it.

An object of the present invention is to provide a light emitting device capable of suppressing the amount of heat generated by a light emitting diode and preventing the light emitting diode from being overheated without reducing the amount of light even when the light emitting diode is a high-power light emitting diode.

The invention according to claim 1 is the improvement in a light emitting device 10 comprising one or more light emitting diodes 11 and a lighting circuit 12 for lighting the light emitting diodes 11, as shown in FIG. 1.

Its characterized configuration is in that the lighting circuit 12 has a switching regulator 13 for converting a DC power into a pulse power, an output control portion 14 for lowering the voltage of a DC power converted by the switching regulator 13, a pulse width adjusting oscillation means 16 for adjusting the pulse width of a pulse power lowered in voltage by the output control portion 14, and a limiting resistor 17 for limiting in current a pulse power adjusted in pulse width by the pulse width adjusting oscillation means 16 and outputting the pulse power to the light emitting diodes 11.

The light emitting device defined in claim 1 converts a DC power into a pulse power by means of the switching regulator 13, lowers the voltage of this pulse power by means of the output control portion 14, adjusts the pulse width of this pulse power by means of the pulse width adjusting oscillation means 16, further limits the current of this pulse power by means of the limiting resistor 17 and then outputs this pulse power to the light emitting diodes 11. Due to this, since an optimum pulse power can be efficiently outputted to a light emitting diode 11 even if it is a high-power light emitting diode 11, it is possible to suppress the amount of heat generated without reducing the amount of light of the light emitting diode 11.

The invention according to claim 2 is characterized in that in the invention according to claim 1, as shown in FIGS. 1 and 2, the output control portion 14 has a first resistor 14*a* one end of which is connected to a compared voltage input of a voltage comparator 13*b* of the switching regulator 13 and the other end of which is grounded through a waveform shaping capacitor 14*c* and a second resistor 14*b* one end of which is connected to the compared voltage input of the above-mentioned voltage comparator 13*b* and the other end of which is grounded, wherein the first resistor 14*a* has a resistance value of 3.0 kΩ to 9.0 kΩ, the second resistor 14*b* has a resistance value of 1.0 kΩ to 2.0 kΩ, the ratio in resistance value of the first resistor 14*a* to the second resistor 14*b* is 1.5 to 9.0, and the limiting resistor 17 has a resistance value of 1.0 Ω to 100.0 Ω.

In the light emitting device defined in claim 2, it is possible to set the voltage and current of a pulse power to be outputted to light emitting diodes 11 at the respective optimum values for making the light emitting diodes 11 emit light by setting the respective resistance values of the first and second resistors 14*a* and 14*b* of the output control portion 14 and the ratio of these resistance values at specified values within their specified ranges and by setting the resistance value of the limiting resistor 17 at a specified value within its specified range.

The invention according to claim 3 is characterized by the invention according to claim 1, wherein further a light emitting diode 11 has a forward current of 100 mA to 1000 mA, a pulse forward current of 200 mA to 2000 mA, a allowable reverse current of 50 mA to 250 mA, a power dissipation of 1.0 to 8.0 W, an operating temperature of −30 to 85° C., a storage temperature of −40 to 100° C., and a dice temperature of 80 to 160° C.

The light emitting device defined in claim 3 can suppress the amount of generated heat without reducing the amount of light of a light emitting diode 11 even when it is a high-power light emitting diode 11.

According to the present invention, since a light emitting device is configured so that a switching regulator converts a DC power into a pulse power, an output control portion lowers the voltage of this pulse power, a pulse width adjusting oscillation means adjusts the pulse width of this pulse power, and further a limiting resistor limits and outputs the current of this pulse power to a light emitting diode, it is possible to efficiently output the optimum pulse power for a light emitting diode even when it is a high-power light emitting diode. As a result, since it is possible to suppress the amount of generated heat without reducing the amount of light of the light emitting diode, it is possible to prevent the light emitting diode from being overheated.

And when one end of a first resistor the other end of which is connected to a compared voltage input of a voltage comparator of a switching regulator is grounded through a waveform shaping capacitor, one end of a second resistor the other end of which is connected to the compared voltage input of the above-mentioned voltage comparator is grounded, the first resistor has a resistance value of 3.0 kΩ to 9.0 kΩ, the second resistor has a resistance value of 1.0 kΩ to 2.0 kΩ, the ratio in resistance value of the first resistor to the second resistor is 1.5 to 9.0, and the limiting resistor has a resistance value of 1.0 Ω to 100.0 Ω, it is possible to set the voltage and current of a pulse power to be outputted to a light emitting diode at the respective optimum values for making the light emitting diode emit light. As a result, it is possible to efficiently output the optimum pulse power to the light emitting diode.

Even by using as a light emitting diode a high-power light emitting diode having a forward current of 100 mA to 1000 mA, a pulse forward current of 200 mA to 2000 mA, a allowable reverse current of 50 mA to 250 mA, a power dissipation of 1.0 to 8.0 W, an operating temperature of −30 to 85° C., a storage temperature of −40 to 100° C., and a dice temperature of 80 to 160° C., it is also possible to suppress the amount of generated heat without reducing the amount of light of a light emitting diode. As a result, it is possible to prevent the light emitting diode from being overheated.

EXPLANATION OF NUMERALS

Figure 1:
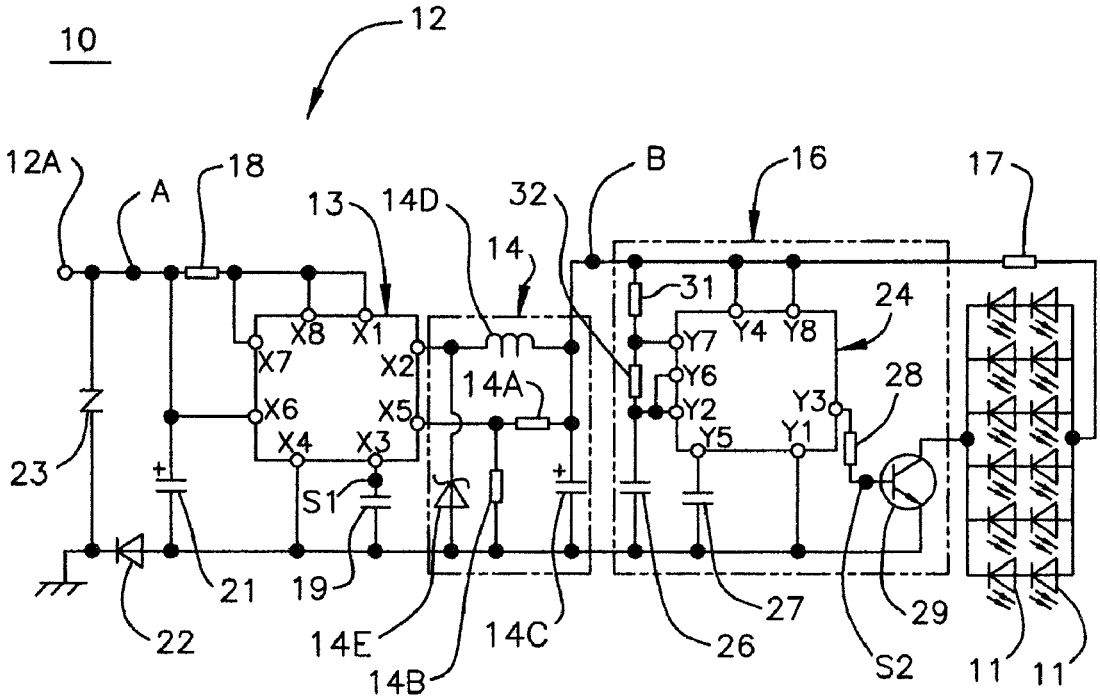
FIG. 1 is a lighting circuit diagram of a light emitting device of an embodiment and example 1 of the present invention.

10 Light emitting device
11 Light emitting diode
12 Lighting circuit
13 Switching regulator
13*b* Voltage comparator
14 Output control portion
14*a* First resistor
14*b* Second resistor
16 Pulse width adjusting oscillation means
17 Limiting resistor

DETAILED DESCRIPTION OF THE PREFERRED EMBODIMENTS

Next, the best mode for carrying out the present invention is described with reference to the drawings.

First Embodiment

As shown in FIG. 1, a light emitting device 10 comprises twenty light emitting diodes 11 and a lighting circuit 12 for lighting these light emitting diodes 11. The twenty light emitting diodes 11 are configured so as to connect in parallel six sets of light emitting diodes 11, said sets each having two light emitting diodes connected in series. A high-power light emitting diode is used as each of these light emitting diodes 11. Concretely, there is used a light emitting diode having a forward current of 100 mA to 1000 mA, preferably 400 mA to 700 mA, a pulse forward current of 200 mA to 2000 mA, preferably 350 mA to 1000 mA, a allowable reverse current of 50 mA to 250 mA, preferably 80 mA to 150 mA, a power dissipation of 1.0 to 8.0 W, preferably 1.5 to 5 W, an operating temperature of −30 to 85° C., preferably −30 to 80° C., a storage temperature of −40 to 100° C., preferably 0 to 80° C., and a dice temperature of 80 to 160° C., preferably 80 to 120° C. (for example, LED of a white chip type: NCCW022S made by NICHIA CORPORATION). Although in this example twenty light emitting diodes are connected to a lighting circuit, a single light emitting diode or 2 to 11 or 13 or more light emitting diodes may be connected. In case of using a plurality of light emitting diodes, these diodes may be connected in series or in parallel, or some of diodes connected in series may be further connected in parallel. And a dice temperature refers to the temperature of a light emitting diode element (chip).

A lighting circuit 12 has a switching regulator 13 for converting a DC power of a battery or the like (not illustrated) into a pulse power, an output control portion 14 for lowering the voltage of a pulse power converted by the switching regulator 13, a pulse width adjusting oscillation means 16 for adjusting the pulse width of a pulse power lowered in voltage by the output control portion 14, and a limiting resistor 17 for limiting in current and outputting a pulse power adjusted in pulse width by the pulse width adjusting oscillation means 16 to a light emitting diode 11. A battery or the like is connected to an input terminal 12*a* and its DC voltage is 9 to 30 V. Hereupon, it is as a result of considering a battery mounted primarily on a passenger car or a truck that the DC voltage of a battery or the like is limited within a range of 9 to 30 V. And it is preferable that the input power of a battery or the like is 5 to 15 W.

Figure 2:
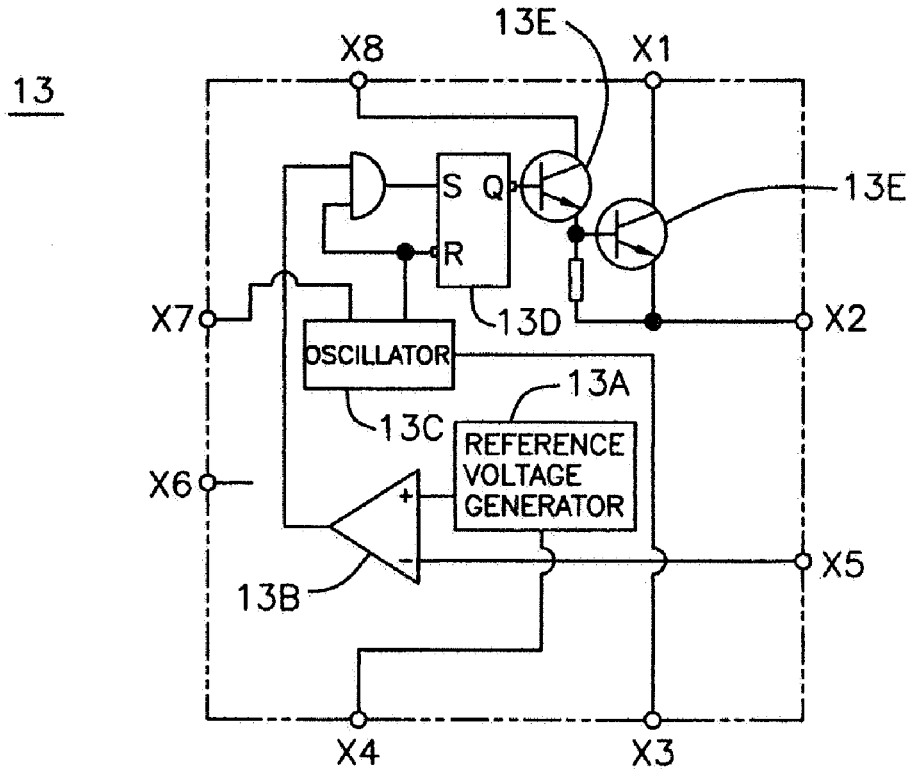
FIG. 2 is a circuit block diagram of a switching regulator of the light emitting device.
Figure 4:
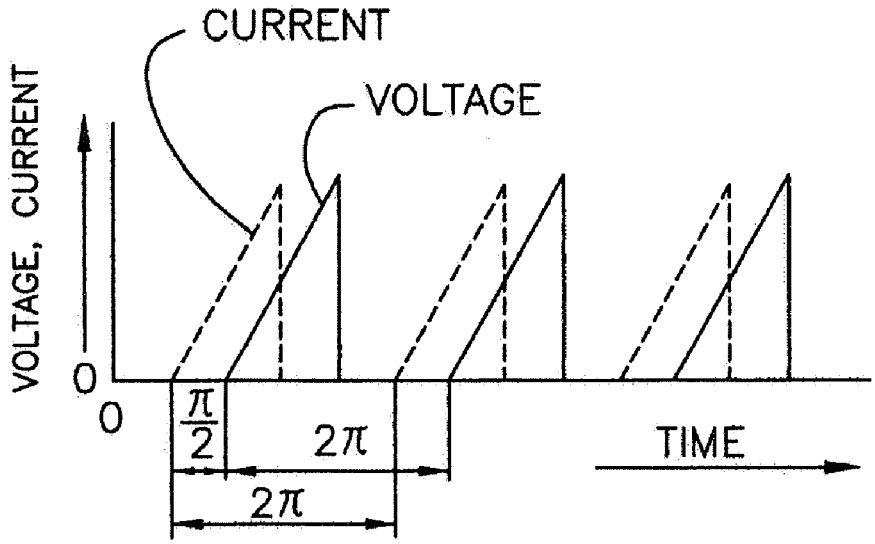
FIG. 4 is a graph showing the difference in phase between the pulse voltage and the pulse current of a pulse power converted by the switching regulator.

On the one hand, in this example the switching regulator 13 is accommodated in a DIP (Dual In line Package) of 8 pins (terminals X1 to X8) and is composed of a reference voltage comparing block, an oscillating circuit block and a switching block (FIG. 2). Hereupon, eight terminals X1 to X8 of a switching regulator 13 shown in FIG. 2 correspond to eight terminals X1 to X8 of the switching regulator 13 shown in FIG. 1. The reference voltage comparing block is configured so as to make a reference voltage generator 13*a* generate a reference voltage of 1.25 V, make a voltage comparator 13*b* detect whether a comparative voltage obtained by dividing an output voltage is lower or higher than the reference voltage, send a power from the input if the comparative voltage is lower than the reference voltage, and suppress a power to the output if the comparative voltage is higher than the reference voltage. And the oscillating circuit block is configured so that the output of an oscillator 13*c* is transferred to a flip-flop circuit 13*d* for a switching control to drive a switching transistor 13*e*. Further, the switching block is configured so that the switching transistor 13*e* is controlled by the output of the voltage comparator 13*b* and the output of the oscillator to output a pulse power of 30 kHz to 40 kHz, preferably 36 kHz in frequency. The oscillator 13*c* is made to make it possible to detect the voltage of an overcurrent detecting resistor 18, deter an oscillating operation in an overcurrent state to prevent the switching transistor 13*e* from being damaged and change the oscillation frequency (switching frequency) by means of a timing capacitor 19 one end of which is connected to terminal X3 of the switching regulator 13 and the other end of which is grounded. And the frequency of a pulse power described above is measured at point S1 between terminal X3 of the switching regulator 13 and the timing capacitor 19 (FIG. 1). Hereupon, the reason why the frequency of a pulse power converted by the switching regulator 13 is limited within a range of 30 kHz to 40 kHz is that adjustment of the pulse width of a pulse power by the pulse width adjusting oscillation means 16 is made to be easily performed. The resistance value of the overcurrent detecting resistor 18 is 0.2 Ω in this example and the electrostatic capacity of the timing capacitor 19 is 1000 pF in this example. And in FIG. 1, numeral 21 is an electrolytic capacitor of 100 μF in electrostatic capacity, numeral 22 is a varistor (surge absorber), and numeral 23 is a diode. Further, the difference in phase between the pulse voltage and the pulse current of a pulse power converted by the switching regulator 13 can be set within a range of $\pm\pi/2$, and as shown in FIG. 4, this example advances a saw-tooth pulse current by about $\pi/2$ in phase relative to a saw-tooth pulse voltage and maintains this phase difference also after the pulse power has passed through the output control portion 14 and the pulse width adjusting oscillation means 16. Due to this, since the power factor (the ratio of effective power to apparent power) of a pulse power supplied to a light emitting diode 11 can be adjusted, it is possible to suppress the amount of generated heat of the light emitting diode 11.

The output control portion 14 has a first resistor 14*a* one end of which is connected to a compared voltage input of a voltage comparator 13*b* of a switching regulator 13 and the other end of which is grounded through a waveform shaping capacitor 14*c*, and a second resistor 14*b* one end of which is connected to the compared voltage input of said voltage comparator 13*b* and the other end of which is grounded, a coil 14*d* one end of which is connected to an emitter of a switching transistor 13*e* of said switching regulator 13 and the other end of which is connected to the waveform shaping capacitor 14*c*, and a Schottky diode 14*e* one end of which is connected to the emitter of said switching transistor 13*e* and the other end of which is grounded. The resistance value of said first resistor 14*a* is set at 3.0 kΩ to 9.0 kΩ, preferably 3.5 kΩ to 8.5 kΩ, the resistance value of the second resistor 14*b* is set at 1.0 kΩ to 2.0 kΩ, preferably 1.0 kΩ to 1.8 kΩ, the ratio of the resistance value of the first resistor 14*a* to the resistance value of the second resistor 14*b* is set at 1.5 to 9.0, preferably 2.0 to 7.0. Hereupon, the reason why the resistance value of the first resistor 14*a* is limited within a range of 3.0 kΩ to 9.0 kΩ is that a resistance value less than 3.0 kΩ makes a great amount of current flow through a light emitting diode to make the amount of generated heat excessively large and a resistance value exceeding 9.0 kΩ makes the amount of emitted light remarkably low in case that the voltage of a forward current is not higher than 9 V. And the reason why the resistance value of the second resistor 14*b* is limited within a range of 1.0 kΩ to 2.0 kΩ is that a resistance value less than 1.0 kΩ makes a great amount of current flow through a light emitting diode to make the amount of generated heat excessively large and a resistance value exceeding 2.0 kΩ increases the amount of heat generated in the second resistor itself to raise the temperature of a substrate mounted with this resistor. Further, the reason why the ratio of the resistance value of the first resistor 14*a* to the resistance value of the second resistor 14*b* is limited within a range of 1.5 to 9.0 is that a ratio less than 1.5 makes the output of a light emitting diode insufficient and a ratio exceeding 9.0 makes the amount of emitted light of a light emitting diode remarkably low in case that the voltage of a forward current is not higher than 9 V. In this example, said waveform shaping capacitor 14*c* is an electrolytic capacitor used for forming the waveform of a pulse power from a saw-tooth waveform into a rectangular waveform, and its electrostatic capacity is 220 μF. And in this example, the inductance of said coil 14*d* is 220 μH. The voltage of a pulse power outputted from the switching regulator 13 is lowered to 5 to 12 V, preferably 6 to 9 V by said output control portion 14. Hereupon, the reason why the voltage of a pulse power lowered by the output control portion 14 is limited within a range of 5 to 12 V is that a voltage lower than 5 V makes the amount of emitted light of a light emitting diode insufficient and a voltage exceeding 12 V makes the amount of heat generated in a light emitting diode excessively large.

Figure 3:
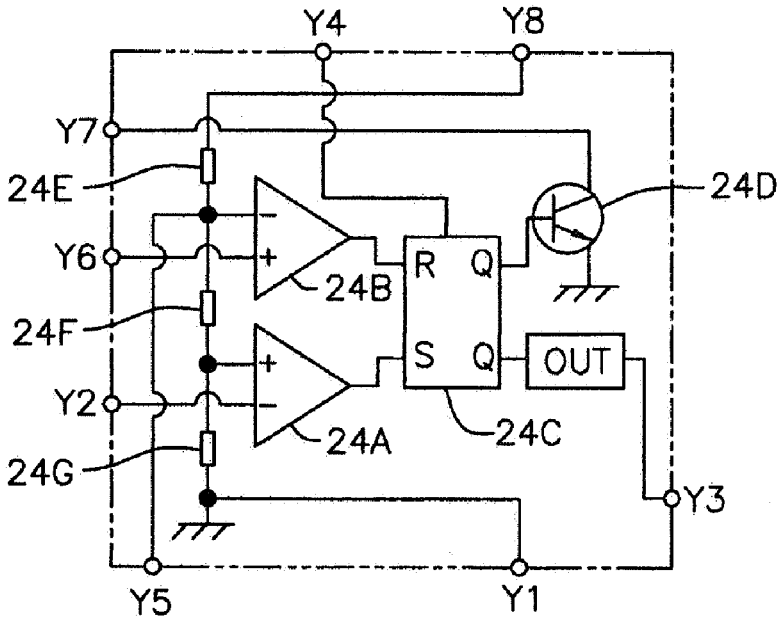
FIG. 3 is a circuit block diagram of a pulse width adjusting oscillation means of the light emitting device.

In this example, the pulse width adjusting oscillation means 16 comprises a timer 24 composed of an IC called NE555 accommodated in a DIP (Dual In line Package) of 8 pins (terminals Y1 to Y8), first and second pulse width adjusting resistors 31 and 32 connected to the timer 24, a pulse width adjusting capacitor 26 connected to the timer 24, and an output transistor 29 connected through a resistor 28 to the timer 24. Hereupon, eight terminals Y1 to Y8 of the timer 24 shown in FIG. 3 correspond to eight terminals Y1 to Y8 of the timer 24 shown in FIG. 1. The timer 24 has first and second voltage comparators 24*a* and 24*b*, a flip-flop circuit 24*c*, a discharging transistor 24*d*, and three resistors 24*e*, 24*f* and 24*g* (FIG. 3). The three resistors 24*e*, 24*f* and 24*g* are connected in series with each other, and divide a pulse voltage applied to terminal Y8 (hereinafter, referred to as voltage Y8) into three. That is, one-third voltage of voltage Y8 is applied to a plus input terminal of the first voltage comparator 24*a* and two-thirds voltage of voltage Y8 is applied to a minus input terminal of the second voltage comparator 24*b*. And a configuration is made so that terminal S of the flip-flop circuit 24*c* comes to level H to bring the flip-flop circuit 24*c* into a set state when a pulse voltage applied to terminal Y2 (trigger) becomes ⅓ or lower of voltage Y8. Further, a configuration is made so that terminal R of the flip-flop circuit 24*c* comes to level H to bring the flip-flop circuit 24*c* into a set state when a pulse voltage applied to terminal Y6 (threshold) becomes ⅔ or higher of voltage Y8.

On the one hand, the first pulse width adjusting resistor 31 is connected between terminal Y4 and terminal 7 of the timer 24, and the second pulse width adjusting resistor 32 is connected between terminal Y7 and terminal Y2 of the timer. And one end of the pulse width adjusting capacitor 26 is connected to terminal Y2 of the timer 24 and the other end is grounded. Further, the base of the output transistor 29 is connected through the resistor 28 to terminal Y3 of the timer 24, the collector of the output transistor 29 is connected to the light emitting diodes, and the emitter of the output transistor 29 is grounded. By the pulse width adjusting oscillation means 16 composed of said first and second pulse width adjusting resistors 31 and 32, the pulse width adjusting capacitor 26, the timer 24, the output transistor 29 and the like, the pulse width of a pulse power is adjusted and the frequency of the pulse power is determined. That is, the frequency of a pulse power outputted from the output control portion 14 is adjusted by this pulse width adjusting oscillation means 16 to 60 to 100 Hz, preferably 70 to 90 Hz, and more preferably 80 Hz. Hereupon, the reason why the frequency of a pulse power adjusted by the pulse width adjusting oscillation means 16 is limited within a range of 60 to 100 Hz is that a frequency lower than 60 Hz makes the light emitted by a light emitting diode into a visually discontinuous light to eye and a frequency exceeding 100 Hz weakens the effect of suppressing generation of heat. In case of adjusting to 80 Hz the frequency of a pulse power adjusted by the pulse width adjusting oscillation means 16, the resistance values of the first and second pulse width adjusting resistors 31 and 32 are set at 10 kΩ and 91 kΩ respectively, and the electrostatic capacity of the pulse width adjusting capacitor 26 is adjusted to 0.1 μF. And the electrostatic capacity of a capacitor 27 one end of which is connected to Y5 of the timer 24 and the other end of which is grounded is set at 0.1 μF. However, the frequency of a pulse power adjusted by the pulse width adjusting oscillation means 16 varies according to the resistance values of the first and second resistors 14*a* and 14*b* of the output control portion 14, the resistance value of the limiting resistor 17, the number of light emitting diodes 11, the method of connection and the like. And the duty ratio of a pulse power is not necessarily 50% but can be properly set within a range of 40 to 60%. Due to this, since a pulse power supplied to a light emitting diode 11 can be adjusted, the amount of heat generated in a light emitting diode 11 can be suppressed. Hereupon, the duty ratio refers to a value representing in percentage the ratio of the high pulse width to the one-period width in a pulse power adjusted by the pulse width adjusting oscillation means 16. And the frequency of a pulse power as described above was measured at point S2 between the output transistor 29 and the resistor 28 (FIG. 1).

On the one hand, one end of the limiting resistor 17 is connected to terminal Y8 of the timer 24 and the other end is connected to the light emitting diodes 11. The resistance value of this limiting resistor 17 is set at 1.0 Ω to 100.0 Ω, preferably 1.0 Ω to 40.0 Ω. Hereupon, the reason why the resistance value of the limiting resistor 17 is limited within a range of 1.0 Ω to 100.0 Ω is that a resistance value less than 1.0 Ω makes a large amount of current flow through the light emitting diodes to make the amount of heat generated in the light emitting diodes excessively large and a resistance value exceeding 100.0 Ω makes the amount of heat generated in the limiting resistor itself excessively large.

Figure 5:
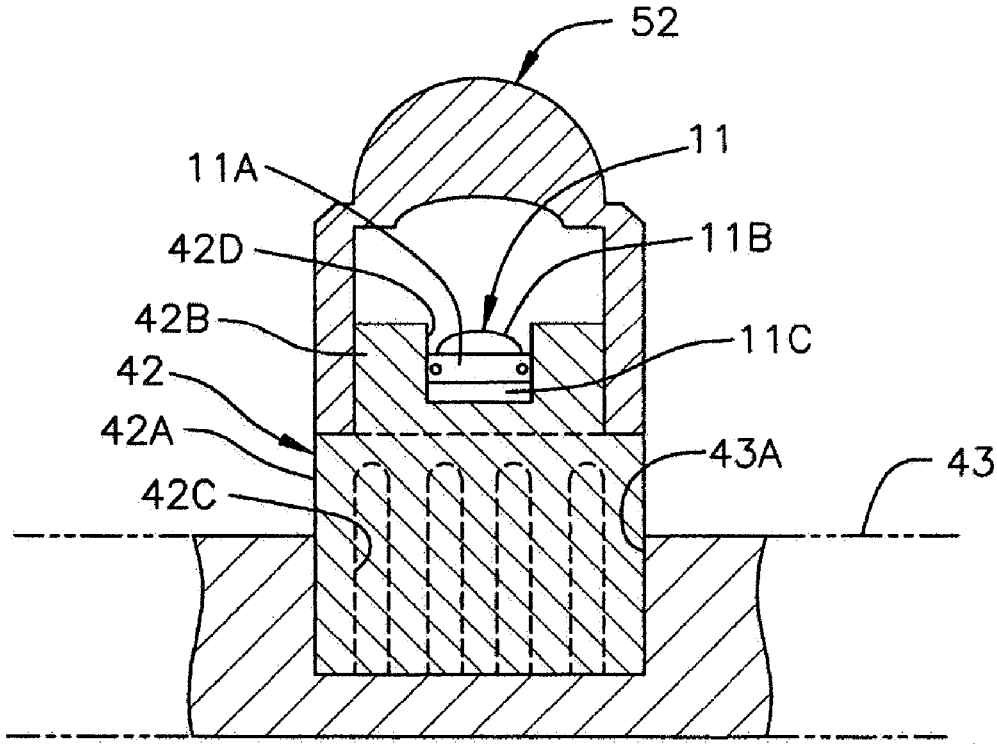
FIG. 5 is a sectional view of a main part including a light emitting diode, a lens and a heat-radiating member of the light emitting device.

As shown in FIG. 5, a light emitting diode 11 has a base 11*a* having a light emitting element built in it, a first lens 11*b* mounted on the surface of the base 11*a* and a heat-radiating member 11*c* attached to the back face of the base 11*a*. This light emitting diode 11 is mounted on a second heat-radiating member 42. The second heat-radiating member 42 is composed of a large-diameter portion 42*a* formed into a large-diameter cylinder and a small-diameter portion 42*b* formed into a cylinder smaller in diameter than the large-diameter portion 42*a*. A plurality of heat-radiating grooves 42*c* extending along the central line of the large-diameter portion 42*a* are formed at specified intervals on the outer circumferential face of the large-diameter portion 42*a*, and a hollow 42*d* in which said light emitting diode 11 is to be inserted and mounted is formed in the small-diameter portion 42*b*. After the light emitting diode 11 has been inserted and mounted in said hollow 42*d*, a second lens made of transparent acrylic resin 52 is fitted and adhered into the small-diameter portion 42*b*. And the large-diameter portion 42*a* of the second heat-radiating member 42 is inserted and adhered into a hole 43*a* of a base member 43. The holes 43*a* being the same in number as the light emitting diodes 11 are formed at specified intervals in the base member 43. A metal plate having a good thermal conductivity such as an anodized aluminum plate or the like is used as the first heat-radiating member 11*c*, and the second heat-radiating member 42 and the base member 43 can be formed out of a high thermal-conductivity resin. It is preferable that PP (polypropylene) and PA6 (Polyamide 6) filled with a filler primarily composed of graphite powder are used as this high thermal-conductivity resin. And it is preferable that methyl chloride is applied to one or both of the outer circumferential face of the large-diameter portion 42*a* and the inner circumferential face of the hole 43*a* directly before the large-diameter portion 42*a* of the second heat-radiating member 42 is inserted into the hole 43*a* of the base member 43. The reason is that since the second heat-radiating member 42 and the base member 43 are adhered to each other by chemical polymerization of methyl chloride and after this adhesion the methyl chloride evaporates, the adhered part between the second heat-radiating member 42 and the base member 43 is not degraded in thermal conductivity. The result exhibits an effect that the heat generated by the light emitting diode 11 smoothly propagates through the adhered part between the second heat-radiating member 42 and the base member 43 and is radiated. It is also acceptable to perform chromium-plating and the like on the outer circumferential face including the insides of the heat-radiating grooves 42*c* of the second heat-radiating member 42 (metal plating on the surface of resin) and perform chromium-plating and the like on the whole surface of the base member 43 including the inner circumferential face of the hole 43*a* (metal plating on the surface of resin) and thereafter insert the large-diameter portion 42*a* of the second heat-radiating member 42 into the hole 43*a* of the base member 43. In this case, since the contact part between the second heat-radiating member 42 and the base member 43 is not degraded but improved in thermal conductivity, the result exhibits an effect that the heat generated by the light emitting diode 11 smoothly propagates through the contact part between the second heat-radiating member 42 and the base member 43 and is radiated. In this case, the second heat-radiating member 42 is fixed to the base member 43 by means of a band, a screw and the like instead of methyl chloride.

The operation of a light emitting device 10 configured in such a way is described.

First, a DC input power outputted from a battery or the like is converted into a pulse power of a specified frequency as described above by the switching regulator 13. Next, the voltage of this pulse power is lowered to a specified level as described above by the output control portion 14. Next, the frequency of this pulse power is adjusted to a specified frequency as described above by the pulse width adjusting oscillation means 16. Further, the electric current of this pulse power is limited to a specified value as described above by the limiting resistor 17. Since a DC input power is adjusted to a specified voltage, current and frequency in such a way and thereafter is outputted to a light emitting diode 11, it is possible to suppress the amount of generated heat of the light emitting diode 11 without reducing the amount of emitted light even when it is a high-power light emitting diode 11. As a result, it is possible to prevent the light emitting diode from damage caused by overheating.

EXAMPLES

Next, examples of the present invention are described in detail together with comparative examples.

Example 1

As shown in FIG. 1, a light emitting device 10 was configured by connecting twelve light emitting diodes 11 to a lighting circuit 12. The twenty light emitting diodes 11 were connected so as to connect in parallel six sets of light emitting diodes, said sets each having two light emitting diodes connected in series. The resistance value of the first resistor 14*a* of the output control portion 14 was set at 7.5 kΩ, the resistance value of the second resistor 14*b* was set at 1.3 kΩ, and the resistance value of the limiting resistor 17 was set at 2.2 Ω.

The second heat-radiating member 42 to have the light emitting diode 11 mounted on it and the base member 43 to have the second heat-radiating member 42 mounted on it used ABS resin rather than a high thermal-conductivity resin (FIG. 5). This light emitting device 10 was determined as example 1.

Example 2

A light emitting device was configured in the same way as example 1 except lighting by means of a lighting circuit ten light emitting diodes connected so as to connect in parallel five sets of light emitting diodes, said sets each having two light emitting diodes connected in series. This light emitting device was determined as example 2.

Example 3

A light emitting device was configured in the same way as example 1 except lighting by means of a lighting circuit eight light emitting diodes connected so as to connect in parallel four sets of light emitting diodes, said sets each having two light emitting diodes connected in series. This light emitting device was determined as example 3.

Example 4

A light emitting device was configured in the same way as example 1 except lighting by means of a lighting circuit six light emitting diodes connected so as to connect in parallel three sets of light emitting diodes, said sets each having two light emitting diodes connected in series. This light emitting device was determined as example 4.

Example 5

A light emitting device was configured in the same way as example 1 except lighting by means of a lighting circuit four light emitting diodes connected so as to connect in parallel two sets of light emitting diodes, said sets each having two light emitting diodes connected in series. This light emitting device was determined as example 5.

Example 6

A light emitting device was configured in the same way as example 1 except lighting two light emitting diodes connected in series by means of a lighting circuit. This light emitting device was determined as example 6.

Example 7

A light emitting device was configured in the same way as example 1 except lighting one light emitting diode by means of a lighting circuit and setting the resistance value of a limiting resistor at 24 Ω. This light emitting device was determined as example 7.

Example 8

A light emitting device was configured in the same way as example 1 except lighting by means of a lighting circuit four light emitting diodes connected so as to connect in parallel two sets of light emitting diodes, said sets each having two light emitting diodes connected in series and setting the resistance value of a limiting resistor at 4.4 Ω. This light emitting device was determined as example 8.

Example 9

A light emitting device was configured in the same way as example 1 except lighting two light emitting diodes connected in series by means of a lighting circuit and setting the resistance value of a limiting resistor at 4.4 Ω. This light emitting device was determined as example 9.

Comparative Example 1

A light emitting device 1 was configured by connecting twelve light emitting diodes 11 to a lighting circuit 2 having no pulse width adjusting oscillation means and no limiting resistor. The twenty light emitting diodes 11 were configured so as to connect in parallel six sets of light emitting diodes, said sets each having two light emitting diodes connected in series. The resistance value of the first resistor 14*a* of the output control portion 14 was set at 7.5 kΩ, the resistance value of the second resistor 14*b* was set at 1.3 kΩ, and the resistance value of the limiting resistor 17 was set at 2.2 Ω. This light emitting device 1 was determined as comparative example 1.

Comparative Example 2

A light emitting device was configured in the same way as comparative example 1 except lighting by means of a lighting circuit six light emitting diodes connected so as to connect in parallel three sets of light emitting diodes, said sets each having two light emitting diodes connected in series. This light emitting device was determined as comparative example 2.

Comparative Example 3

A light emitting device was configured in the same way as comparative example 1 except lighting by means of a lighting circuit four light emitting diodes connected so as to connect in parallel two sets of light emitting diodes, said sets each having two light emitting diodes connected in series. This light emitting device was determined as comparative example 3.

(Comparison Test and Evaluation)

Figure 6:
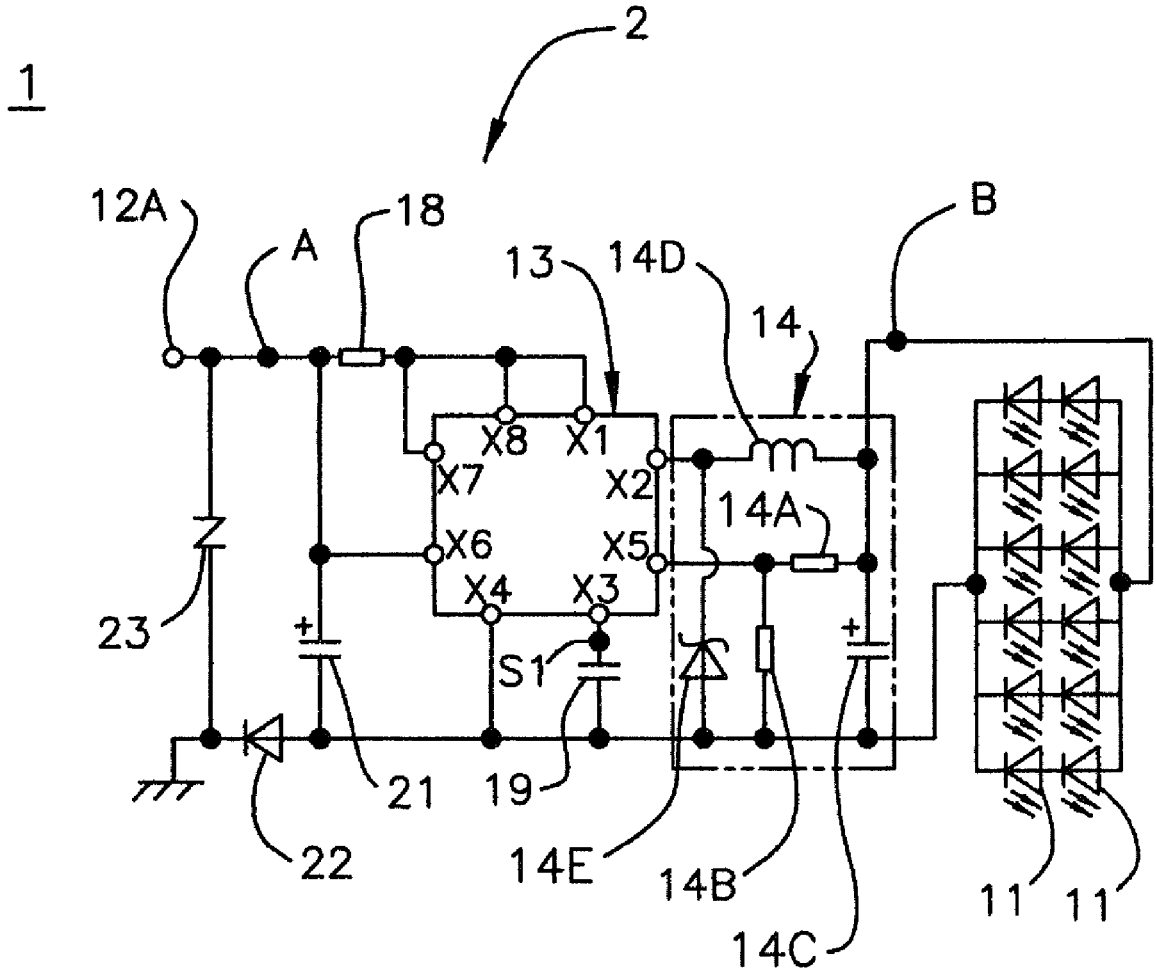
FIG. 6 is a lighting circuit diagram of a light emitting device of comparative example 1.

The saturated temperature of light emitting diodes and the time until the light emitting diodes reach 85° C. were respectively measured when the light emitting diodes were lighted by means of the light emitting devices of examples 1 to 9 and comparative examples 1 to 3. And the voltage and current at point A in FIG. 1 or FIG. 6 were measured, the initial voltage, final voltage and current at point B in FIG. 1 or FIG. 6 were measured, and the frequency at point S in FIG. 1 was measured. Further the temperature of light emitting diodes was measured on the lower face of the first heat-radiating member of FIG. 5. The result is shown in Table 1. The frequency at point S1 in FIG. 1 and FIG. 6 was about 36 kHz.

TABLE 1

| | LED | | Resistance value of limiting | DC power at point A | | Pulse power at point B | | | | Saturated | Time for reaching |
|---|---|---|---|---|---|---|---|---|---|---|---|
| | Series | Parallel | resistor (Ω) | Voltage (v) | Current (mA) | Initial voltage (V) | Final voltage (V) | Current (mA) | Frequency at point S2 (Hz) | temperature (° C.) | 85° C. (Second) |
| Example 1 | 2 | 6 | 2.2 | 13.8 | 440 | 8.18 | 8.03 | 600 | 89.1 | 51.0 | — |
| Example 2 | 2 | 5 | 2.2 | 13.8 | 440 | 8.19 | 8.09 | 580 | 86.9 | 58.0 | — |
| Example 3 | 2 | 4 | 2.2 | 13.8 | 430 | 8.30 | 8.17 | 560 | 84.9 | 64.1 | — |
| Example 4 | 2 | 3 | 2.2 | 13.8 | 410 | 8.36 | 8.29 | 540 | 81.6 | 75.3 | — |
| Example 5 | 2 | 2 | 2.2 | 13.8 | 310 | 8.35 | 8.32 | 430 | 80.6 | 87.0 | 560 |
| Example 6 | 2 | 1 | 2.2 | 13.8 | 190 | 8.40 | 8.40 | 260 | 79.7 | 100.6 | 320 |
| Example 7 | 1 | | 24.0 | 13.8 | 90 | 8.40 | 8.40 | 130 | 78.9 | 64.0 | — |
| Example 8 | 2 | 2 | 4.4 | 13.8 | 220 | 8.38 | 8.35 | 280 | 80.0 | 75.4 | — |
| Example 9 | 2 | 1 | 4.4 | 13.8 | 120 | 8.40 | 8.40 | 150 | 79.1 | 84.9 | — |
| Comparative example 1 | 2 | 6 | 2.2 | 13.8 | 740 | 6.66 | 6.58 | 1190 | — | 89.0 | 84 |
| Comparative example 2 | 2 | 3 | 2.2 | 13.8 | 780 | 7.20 | 6.98 | 1140 | — | 114.0 | 32 |
| Comparative example 3 | 2 | 2 | 2.2 | 13.8 | 780 | 7.80 | 7.65 | 1080 | — | 156.0 | 20 |

As apparently seen from Table 1, while the saturated temperature was as high as 89.0° C. in comparative example 1, the saturated temperature was as low as 51.0° C. in example 1. And while the saturated temperature was as high as 114.0° C. in comparative example 2, the saturated temperature was as low as 75.3° C. in example 4. Further, while the saturated temperature was as high as 156.0° C. in comparative example 3, the saturated temperature was as low as 87° C. in example 5. The saturated temperature was as low as 58.0 to 84.9° C. in examples 2, 3 and 7 to 9. On the one hand, in example 6, since the saturated temperature is as comparatively high as 100.6° C. but the time until reaching 85° C. is as comparatively long as 320 seconds, the saturated temperature is considered to be capable of being lowered by forming a second heat-radiating member to have a light emitting diode mounted on it and a base member to have the heat-radiating member mounted on it out of a high thermal-conductivity resin or performing metal plating on this high thermal-conductivity resin.

What is claimed is:

1. A light emitting device comprising one or more light emitting diodes and a lighting circuit for lighting said light emitting diodes, wherein;

said lighting circuit has;

a switching regulator for converting a DC power into a pulse power, an output control portion for lowering the voltage of a pulse power converted by said switching regulator, a pulse width adjusting oscillation means for adjusting the pulse width of a pulse power lowered in voltage by said output control portion, and a limiting resistor for limiting in current a pulse power adjusted in pulse width by said pulse width adjusting oscillation means and outputting the pulse power to said light emitting diodes and wherein said output control portion has a first resistor one end of which is connected to a compared voltage input of a voltage comparator of said switching regulator and the other end of which is grounded through a waveform shaping capacitor, and a second resistor one end of which is connected to the compared voltage input of said voltage comparator and the other end of which is grounded, wherein said first resistor has a resistance value of 3.0 kΩ to 9.0 kΩ, said second resistor has a resistance value of 1.0 kΩ to 2.0 kΩ, the ratio of the resistance value of said first resistor to the resistance value of said second resistor is 1.5 to 9.0, and said limiting resistor has a resistance value of 1.0 Ω to 100.0 Ω.

2. The light emitting device according to claim 1, wherein said light emitting diode has a forward current of 100 mA to 1000 mA, a pulse forward current of 200 mA to 2000 mA, a allowable reverse current of 50 mA to 250 mA, a power dissipation of 1.0 to 8.0 W, an operating temperature of −30 to 85° C., a storage temperature of −40 to 100° C., and a dice temperature of 80 to 160° C.

* * * * *